United States Patent [19]

Ackerman

[11] 4,043,427

[45] Aug. 23, 1977

[54] STAIR ELEVATOR

[76] Inventor: Ray Ackerman, Rte. 292, Holmes, N.Y. 12531

[21] Appl. No.: 668,707

[22] Filed: Mar. 19, 1976

[51] Int. Cl.[2] ..... B66B 9/08

[52] U.S. Cl. ..... 187/12; 187/35

[58] Field of Search ..... 187/12, 13, 14, 10, 187/35, 36, 34

[56] References Cited

U.S. PATENT DOCUMENTS

| | | | |
|---|---|---|---|
| 2,528,265 | 10/1950 | Cretors | 187/12 |
| 2,619,195 | 11/1952 | Scott | 187/12 |
| 2,619,196 | 11/1951 | Scott | 187/14 |
| 2,719,607 | 10/1955 | Scott | 187/14 |
| 2,985,257 | 5/1961 | Jackson | 187/12 |

FOREIGN PATENT DOCUMENTS

| | | | |
|---|---|---|---|
| 2,411,138 | 9/1974 | Germany | 187/48 |

*Primary Examiner*—Evon C. Blunk
*Assistant Examiner*—Jeffrey V. Nase
*Attorney, Agent, or Firm*—John F. Ohlandt

[57] ABSTRACT

A stair elevator including a chair and associated track adapted for support on a stairway, and further including special limit and emergency switches for controlling movement of the chair along the track. An improved braking device is also provided, as well as a unique low voltage control arrangement, an electrical interlock feature, and a re-set feature.

4 Claims, 5 Drawing Figures

FIG. 2
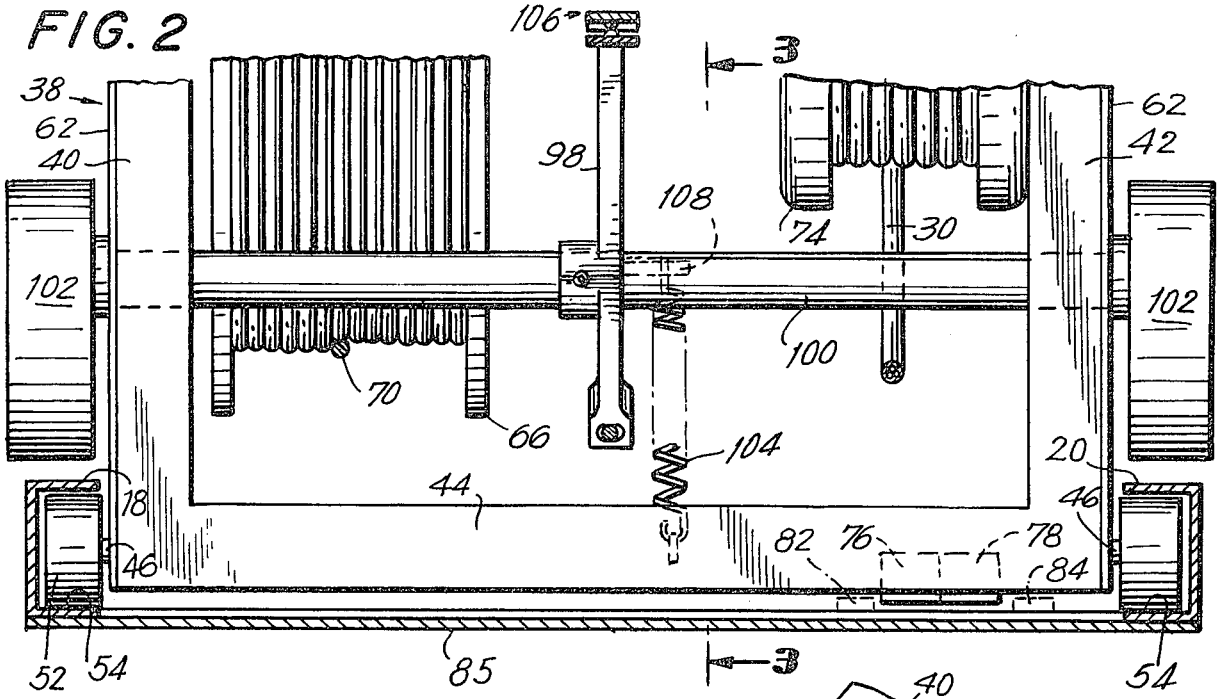
FIG. 3
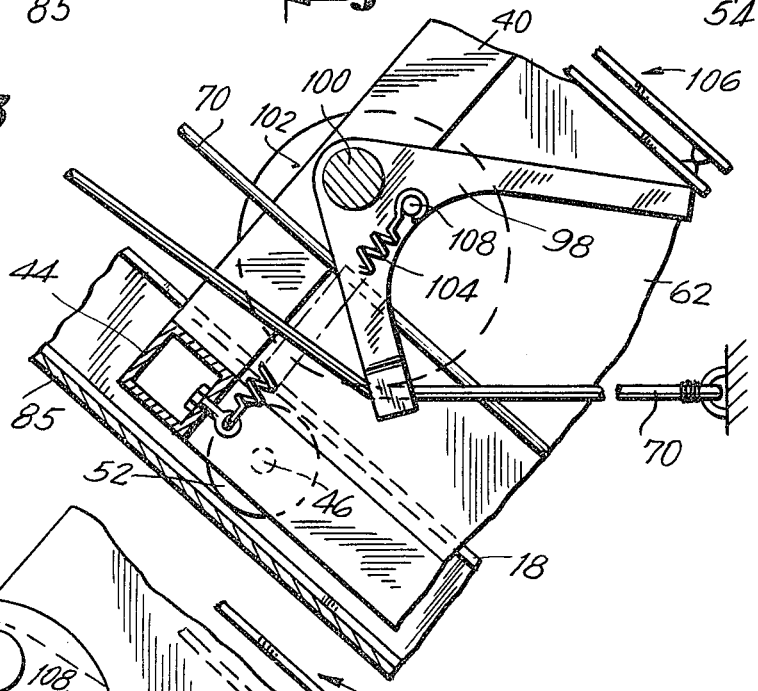
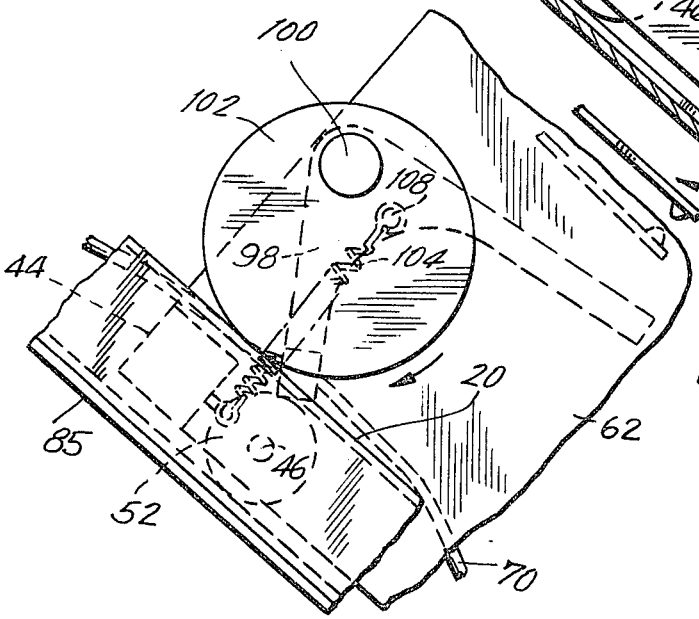
FIG. 4

STAIR ELEVATOR

BACKGROUND, OBJECTS AND SUMMARY OF THE INVENTION

The present invention pertains to a stair elevator and more particularly to the type especially useful for invalids, such elevator being adapted to be supported on a stairway, and including a chair which travels along a track.

In order to furnish background for the several features of the present invention, the stair elevators disclosed in U.S. Pat. Nos. 2,619,195; 2,619,196 and 2,985,257 may be consulted. Like the stair elevator of the present invention, those disclosed in the aforesaid patents include a chair which is operable along a track supported on a stairway, and they generally involve electrical apparatus for effecting and controlling operation of the chair by the invalid or the like. Such prior art systems or schemes have included, inter alia, reversing switches and cam-operated limit switches actuatable at the upper and lower ends of the track so as to control the operation of the driving motor.

It has been found that a troublesome difficulty arises in connection with the operation of limit switches for controlling the driving motor of a stair elevator of the type contemplated. It turns out that any bending or warping of the rails carrying the cam structures which function to actuate the limit micro-switches results in improper functioning of such switches.

Accordingly, it is a primary object of the present invention to overcome the aforesaid difficulty which arises in respect to cam actuation of limit switches.

Another primary object is to provide an improvement in the braking device which operates to stop movement of the chair in the stair elevator whenever a slackening of the drive cable is sensed by a mechanism to be described.

Yet another object of the present invention is to enable operation of a stair elevator under brown-out conditions; that is to say, to permit functioning of the stair elevator even when the supplied voltage, that is, the normal voltage of 110 volts furnished by the utility, has its value significantly reduced.

Another object is to provide a convenient re-set feature in the event that the stair elevator has been stopped by actuation of one of the emergency switches associated with its functioning.

Another object is to provide a suitable interlock means such that only one of the basic relay devices used in the electrical system can be operated at a given time.

Other and further objects, advantages and features of the present invention will be understood by reference to the following specification in conjunction with the annexed drawing, wherein like parts have been given like numbers.

DESCRIPTION OF DRAWING

FIG. 2 is a section along line 2—2 of FIG. 1, especially illustrating the braking mechanism;

FIG. 3 is a section along the line 3—3 of FIG. 2 showing the braking mechanism in the normal operating position;

FIG. 4 is a view similar to FIG. 3 but illustrating the position for the braking mechanism when the cable has gone slack.

DETAILED DESCRIPTION OF THE PREFERRED EMBODIMENT

Figure 1:
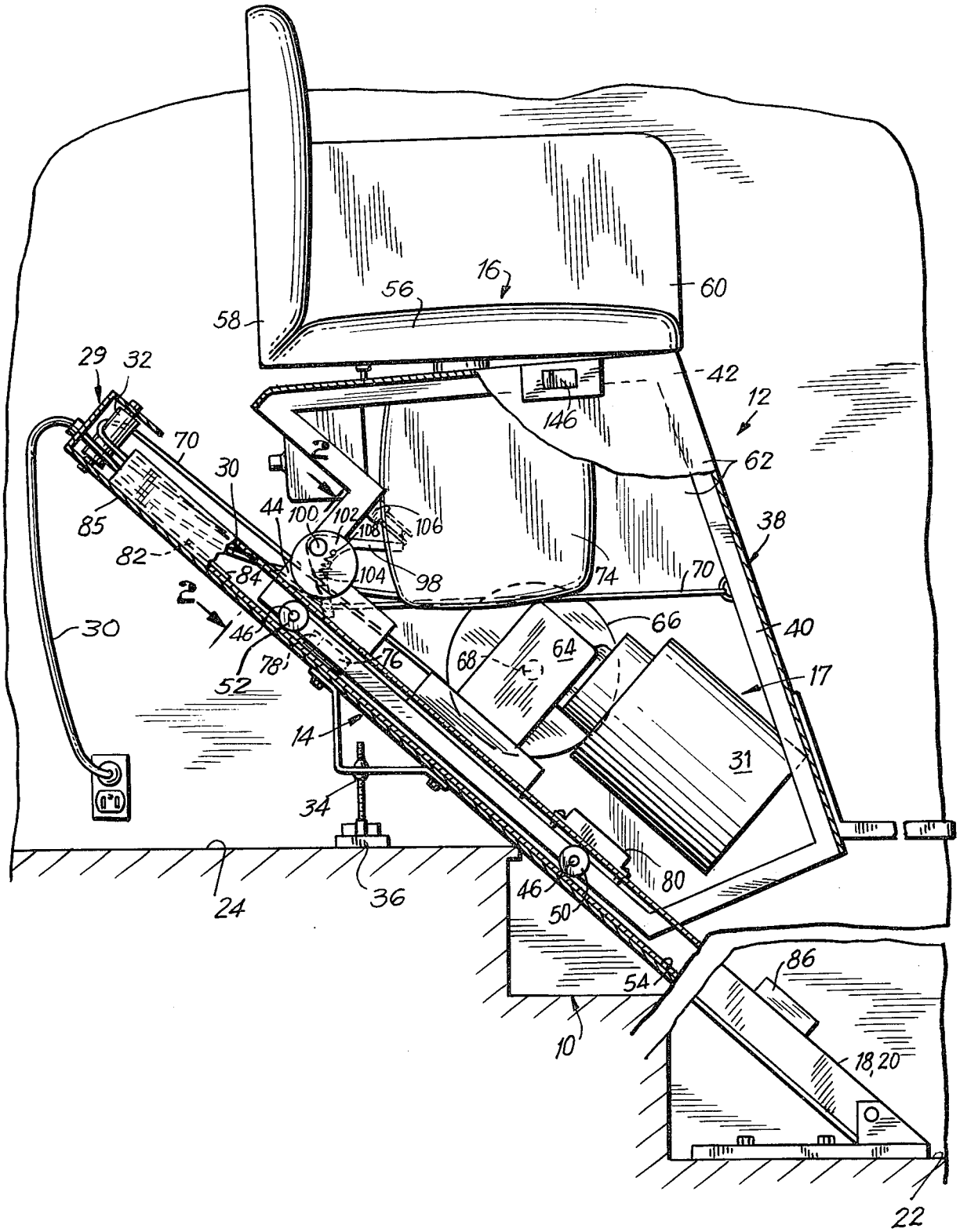
FIG. 1 is a side elevational view of a stairway equipped with a stair elevator in accordance with the preferred embodiment and having controls embodying the several features of the invention, and wherein parts are broken away to better illustrate the features.

Referring now in detail to the drawings, there is generally designated a stairway 10 consisting of conventional treads and risers and on which there is mounted, preferably at the wall side thereof, an elevator 12 of the type to which the present invention pertains. The elevator 12 is preferably self-contained, including an inclined track 14, a chain unit 16, and control apparatus 17, including electrical circuits and electro-mechanical devices, which together embody the several features of the present invention.

The track 14 includes rails 18 and 20 adapted for support on the forward edges of the stairway treads. These rails are preferably channel-shaped for added strength and are of such length as to extend from a lower floor or landing 22 to a point above a higher landing 24, thereby to permit movement of the chair 16 between such landings. The lower ends of the rails are suitably affixed to a plate or the like at the lower landing. The upper ends of the rails 18 and 20 are connected together by a cross member, and another cross member is used to connect the rails at a point approximately midway between the landings.

A housing 29 is provided at the upper end or ends of the rails and serves to house the connection for an electrical cord 30 which transmits its power to a driving motor 31 housed in the chair unit 16. The housing 29 also contains a guide roller or pulley 32 for guiding or controlling the drive cable to be described. The upper end of the track 14 is suitably supported by posts 34 having foot portions 36 adapted to bear on the upper landing.

The chair unit 16 includes a framework 38 having a pair of spaced apart side members 40 and 42. Suitable cross members 44 connect the aforesaid pairs of side members so that a strong structure is provided for the operating elements of the chair unit. Each of members 40 and 42 carries a pair of spindles 46, one at the front and one at the rear of the framework, for mounting wheels 50 and 52 at the front and rear of the unit. The wheels 50 and 52 travel along the bottom portions 54 of the channel-shaped rails 18 and 20, thereby permitting ease of movement of the chair unit along the track.

The chair unit 16 includes a seat 56 supported on the side members 40 and 42, and further includes a back 58 and an arm 60. The side members are enclosed at the sides and in front of the chair by panels 62 so as to form a housing under the seat for a number of components including the aforenoted driving motor 31 and a speed reduction unit 64, which is connected to the motor. A cable winding reel 66 is affixed to the output shaft 68 of the reduction unit 64 so that a steel cable 70, which is looped about a pulley 32 at the upper end of the elevator and secured at one end to the framework, may be appropriately wound and payed out. In order to prevent cable 70 from leaving pulley 32 in the event that the cable becomes slack, a pair of inserts are mounted in close proximity to the pulley 32. Another reel 74 is used for the winding up and paying out of the electrical cord 30, the reel 74 likewise being housed within the chair unit 16.

A proximity switch control scheme is provided in accordance with a principal feature of the present invention. Mounted at the bottom of the framework 38 are the switch assemblies, i.e., the magnetically-responsive contacts, of three independent switches 76,78 and 80, the last named having its contacts at the lower end of the framework 38. The other two switches, 76 and 78, are laterally spaced from each other in the same general area at the upper end of the framework 38. Switch 76 is an emergency switch and switch 78 is an upper limit switch, both of which are connected in a control circuit to be described hereinafter. The switch 80 functions as a down limit switch in the same control circuit. The respective magnets for the switches 76, 78 and 80 may be seen appropriately situated to actuate the respective switch contacts; thus, the magnets 82 and 84 are located at the upper end of the track on the bottom panel 85 and the magnet 86 is affixed at the upper part of the outer rail 20.

An improved braking device in accordance with another feature of the invention is directed to eliminating a hazard which exists with conventional stair elevators. That is to say, conventional braking arrangements involve the use of a torsion spring which has two to three wraps and includes a long arm. The safety shaft, which effectuates movement of eccentrically mounted brake wheels, is normally inserted through the spring wraps and one end is attached directly over a lever to the framework or chassis. The long arm of the spring is customarily bent over this safety lever. However, such an arrangement for the spring tends to weaken it greatly after long use, resulting in poor performance of the braking device.

In accordance with the present invention, the safety lever 98 for the braking device is mounted on a shaft 100 that extends across the rear portion of the framework or chassis 38. On each end of shaft 100 is a suitably knurled eccentric wheel designated 102. When the cable 70 is held taut, then each of the eccentric wheels is held above the track rails. However, breaking or slackening of the cable 70 causes a multi-trap torsion spring 104 arranged in accordance with the present invention to draw the safety lever 98 down, bringing the eccentric wheels against the upper surfaces of the track.

A snap action switch 106 is disposed above the lever 98 and its contacts are closed provided that the lever arm is in the "up" position, in which position the safety wheels are out of contact with the track rails. However, when the safety brake is activated as just described, the contacts of the switch 106 open and power is interrupted from the supply to the driving motor 31.

It will be seen in FIG. 3 that at a point on the safety lever 98, which has been found to be suitable for producing the maximum downward pull on such arm, there is located a hardened shoulder bold 108. The well-tempered multi-wrap torsion spring 104 is drawn between the outer end of the bolt, to which the spring is connected at its one end, downward to the bottom of the framework or chassis 38 to which its other end is connected. This spring is purposely mounted away from the safety lever 98 so as not to inhibit its movement by reason of an accidental hangup on the coil of the spring.

Figure 5:
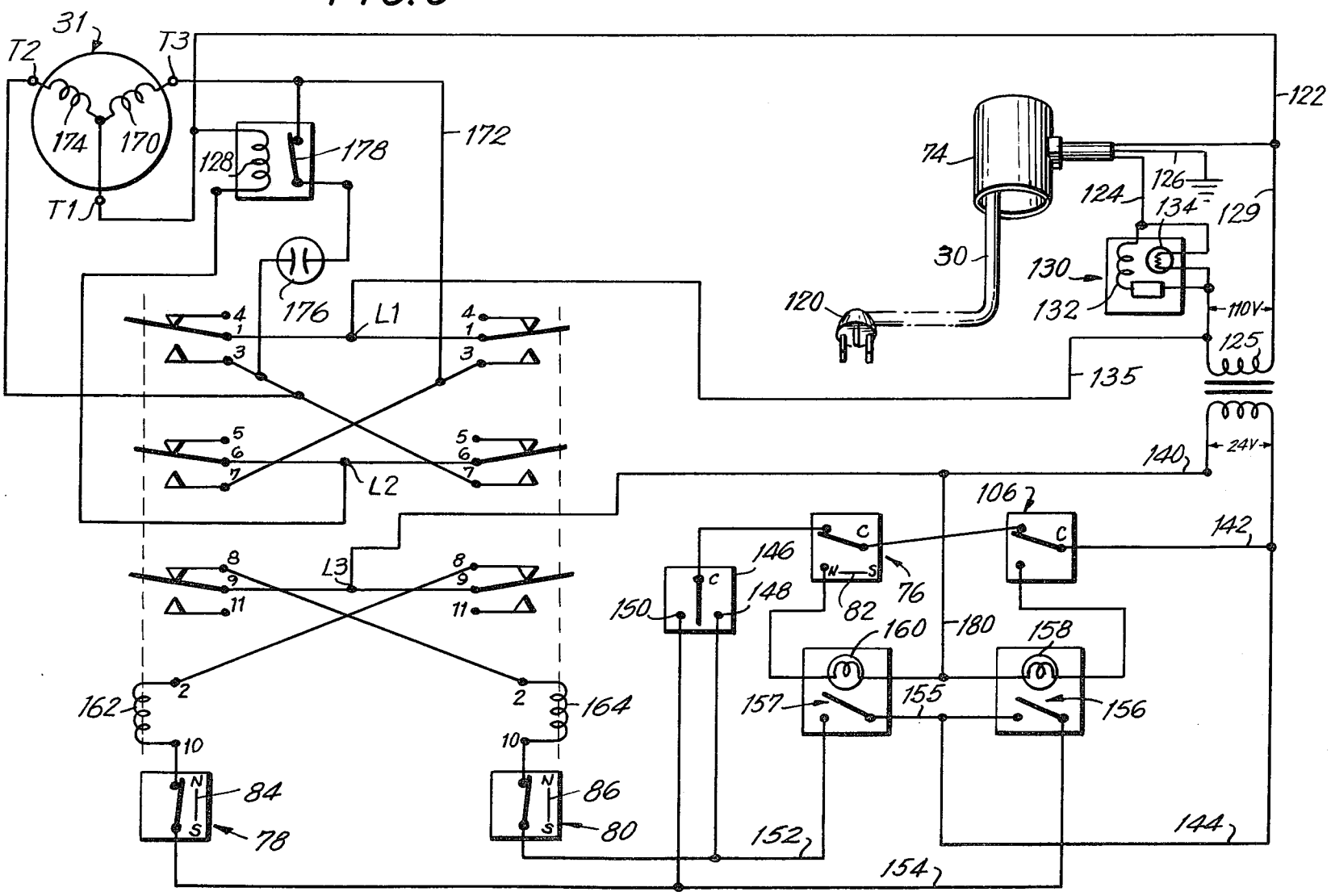
FIG. 5 is a schematic diagram of the electrical control system for the stair elevator.

Referring now particularly to FIG. 5, the electrical control aspects and operation of the present invention will be described. It will be seen that a source of power such as obtained from a conventional outlet is fed by way of a plug 120 through the power cord 30 which is wound around reel 74 so that the cord 30 can be payed out or retracted as the chair unit moves up or down the track. From the reel 74 conductors or leads 122, 124 and 126 are extended, lead 122 being connected to the common terminal T1 of driving motor 31 and also connected to a motor start relay 128, which in turn is further connected to the terminal L2 on a relay contact scheme. Lead 124 furnishes a connection of the 110 volt power supply to a transformer 125, while lead 126 is brought to ground.

The conductor 124 is connected to the transformer through a circuit breaker 130, which includes a relay 132 and a neon trouble light 134. The circuit breaker 130 interrupts power to the circuit in case of an overload, the built-in neon lamp 134 serving as a by-pass on the breaker contacts and lighting when the breaker trips out. The circuit breaker is connected to the primary of transformer 125, the other side of which is connected to return lead 129. Connection is also made from the primary of transformer 125 by way of conductor 135 to terminal L1 of the relay contact scheme aforenoted.

The secondary of transformer 125 is connected by way of lead 140 to terminal L3 of the aforenoted relay contact scheme. The other side of the secondary is connected by way of the respective leads of conductors 142 and 144 to individual switching paths. Thus, lead 142 is connected through the aforenoted cable-slack-sensing switch 106 which is a snap action switch and operates in response to the slackening in cable 70. In series with the upper contact position of switch 106, is the aforenoted emergency switch 76 which is a proximity switch and operates in response to the presence of the magnet 82 already described. It will be seen that there is a connection from the upper stationary contact of this switch to the movable or common contact of the operator's or control switch which is fixed on the chair unit, namely, switch 146. Stationary contacts 148 and 150 of switch 146 are respectively connected to leads 152 and 154 which extend to the up limit switch 78 and to the down limit switch 80, respectively.

The other lead from the secondary transformer 125, i.e., lead 144, is connected to a common line 155 which extends to the two switches 156 and 157, both of which are normally opened, pushbutton switches, the switches 156 on the right serving to function as a cable slackening re-set switch; and that is to say, to be activated or actuated by the operator or repair man when a problem has occurred involving cable breakage or slackening such that a light 158 associated with switch 156 has been illuminated.

Likewise, a light 160 associated with switch 157 functions to indicate that an over-ride or emergency condition at the upper end of the system has occurred. Accordingly, the switch 157 serves as a re-set switch in the event that the eventuality of an over-ride has occurred.

From the individual switches 78 and 80 which serve as up-limit and down-limit switches, connection is made to individual relay coils 162 and 164 respectively. For convenience, the two terminals of the relay coils 162 and 164 have been designated 2 and 10. From each of the terminals 2 of the respective relays, connection is made to terminals 8 of the L3 group of contacts which together function as an interlock feature or arrangement and insure that the individual relays both can't be operated at the same time. It will be understood that this could result in severe damage to the windings of the driving motor 31.

It should be noted that the relays 162 and 164 are fed by low voltage power supply; that is to say, the secondary of transformer 125 is stepped down from the primary supply of 110 volts such that only 24 volts is available therefrom. Accordingly, the system will function under severe brown-out conditions; that is, even with a reduction in the voltage of the primary supply of as much as 20 percent, the effects on the secondary will not be such as to prevent proper operation of the relays 162 and 164, which are the critical elements under brown-out conditions. It will also be understood that the remaining groups of contacts, that is, those connected to the L1 and L2 terminals, are operable on the primary side and hence handle 110 volts; however, this part of the circuitry is not as sensitive to a reduced voltage condition.

Accordingly, it will be appreciated that when the system is set for operation, power is supplied to the common or movable contact of switch 146, provided that cable slack switch 106 has its upper contact closed with its movable contact and the over-ride or emergency switch 76 has the same condition. So long as these conditions obtain, pushing the lever or movable contact of control switch 146 to one side or to the other supplies power alternately to the relays 162 or 164 through the up limit switch 78 or 80, respectively.

Under the assumption that the movable contact or switch 146 is thrown to the right, as seen in FIG. 5, then energization of relay 164 will result in placing power on motor coil 170 connected between motor terminals T1 and T3. This is achieved because power can flow from lead 122 to terminal T1, through coil 170 and by way of lead 172 to contact 3 of relay 164, thence through movable contact 1 of that relay, which contact now has moved so as to engage contact 3, to the L1 terminal and return by way of lead 135. Such power flow as described causes driving motor 31 to run in its counterclockwise mode such that the chair unit 16 moves in the downward direction and does so so long as control switch 146 remains in the proper position, that is, to the right and until proximity switch 80 is actuated by reason of the proximity of the magnet 86 at the bottom of the track to the mating switch contacts mounted on the chair unit. Opening of the normally closed contacts of this down limit proximity switch 80 results in relay 164 dropping out and as a consequence motor 31 is stopped.

On the other hand, if the movable contact of control switch 146 is thrown to the left, then relay 162 is energized. Current now flows through coil 174 of motor 31 because a circuit is now established through contacts 3 and 1 of relay 162 to the return land 135, whereas contacts 1 and 3 of relay 164 are now open. It will be appreciated that relay 164 will be de-energized even in the event that its energizing contacts on the control switch 146 have been shorted from whatever cause, inasmuch as the cross-connection, interlock arrangement removes power to such relay whenever the other relay, that is relay 162, has been energized.

As a result of the energization of relay 162, the driving motor 31 is caused to run in its clockwise mode and the chair unit travels in the upward direction, moving up the track until the up limit proximity switch 78 is actuated by proximity of its magnet with the corresponding switch contacts when the chair unit approaches the top of the track. Consequently, the contacts of that switch 78 open and relay 162 now drops out and the motor 31 is again stopped.

It will be appreciated that capacitor starting is used in connection with the operation of the driving motor 31. Accordingly, it will be seen that a capacitor 176 is selectively connected, regardless of the mode of operation of the motor, in parallel with the two coils 170 and 174; thus, the capacitor is connected between terminals T3 and T2. However, the capacitor is only connected when it is needed during the starting interval by reason of the closing during that interval of switch 178 in series with the capacitor. Such switch is responsive to the starting relay 128 aforenoted, such starting relay being selectively connected from terminal T1 to either terminal T2 in the counterclockwise mode or to terminal T3 when the motor is to operate in the clockwise mode.

In the event that the chair unit 16 for some reason should travel beyond the upper limit established, i.e., beyond the point at which the up limit switch 78 is to operate, provision is made for emergency shutdown. Thus, an emergency or over-ride switch 76 is set to operate under these conditions. Thus, this switch, which is also a magnetically operated proximity switch, having its magnet located at the upper end of the stairway, will be actuated. The result is that current will no longer flow to the control switch 146 since the movable contact of switch 76 has moved down to contact the lower fixed contact. However, a circuit is thereby established through the indicator lamp 160 and thence by way of lead 180 and lead 140 to the secondary of transformer 125. Therefore, the light 160 is illuminated as indicating this particular fault.

A re-set feature is provided in that an indicator button, which is illuminated by lamp 160, serves to actuate the movable contact of switch 157 so that current is thereby supplied to relay 164, thus to cause driving motor 31 to run in its counterclockwise mode, or the downward direction for the chair unit; hence to re-set the apparatus to its proper operational state.

In addition to the re-set of the apparatus, following the emergency condition actuation of switch 76, there is also a re-set provided in the event that the cable slack responsive switch 106 has been actuated. It will be recalled that if the cable 70 should break or become slackened, the safety arm or lever already described will move downwardly and place the knurled safety wheels 102 on the track, locking them into place so that the chair unit will come to rest. Also at the same time that the safety arm moves down, pressure is removed from the lever of switch 106 and, therefore, the movable contact is actuated to its lower position. Consequently, there is again no current available to the control switch and instead current flows through indicator lamp 158, returning by lead 180. The lamp 158 is thus illuminated so as to indicate this fault of cable slackening.

As before, the operator or repair man can conveniently press an associated push button to cause the movable contact of switch 156 to contact its stationary contact. Current can then flow from the lead 144 by way of the contacts of switch 156, then by way of lead 154 to relay 162, thereby causing motor 31 to run in its clockwise mode and hence to cause the chair unit to move upwardly. The slack in the cable 70 will now be taken up by the clockwise rotation of reel 66 until the cable becomes taut such that it will again draw the safety wheels off the track. However, if the cable is broken, the wheels will not re-set into their normal position.

Although in respect to the re-set feature, the schematic of FIG. 5 shows the best mode now contemplated for that feature, another possible embodiment would be to wire the indicator lamps 158 and 160 as a by-pass on the normally closed contacts of the switches 106 and 76, respectively. Thus, the common lead 180 would be eliminated. These lamps would then light or be illuminated when these normally closed contacts become opened; or in other words, when a short no longer exists across the lamps. Nevertheless, in the open contacts state, these lamps would provide enough resistance in the circuit to prevent total energization of either relay 162 or relay 164 (depending on the particular position of control switch 146). The control switch 146 would, of course, have to be closed, by movement to one side or the other, in order to cause illumination of either of the lamps 158 or 160. As before, depending on which emergency or fault condition has occurred, the appropriate re-set push button can then be actuated to produce corrective action. The normally open re-set switches 156 and 157 would be wired as now seen in FIG. 5.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. In a stair elevator, including a track having rails adapted for support on a stairway, a chair unit movable on the track, a reversible driving motor for moving said chair unit along the track, the improvement comprising:

a control switch mounted on the chair unit for operation by the user;

upper and lower limit switches automatically actuatable at the respective upper and lower ends of the track, and an emergency switch automatically actuatable at the upper end of said track;

each of said limit and emergency switches comprising a switch contact assembly, and a cooperating individual magnet, the switch contact assembly or the cooperating individual magnet of both the upper limit switch and the emergency switch being mounted on said chair unit in closely spaced side-by-side staggered relationship and the other of said switch contact assembly or said cooperating individual magnet, being mounted on opposite sides of the switch contact assembly or the cooperating individual magnet mounted on said chair unit and between said rails, so that as the individual contact assemblies are moved relative to the individual cooperating magnets, the emergency switch is actuated after said upper limit switch has been actuated.

2. A device as defined in claim 1, further comprising:

control circuitry for said elevator, including a power supply connected to said chair unit, a transformer connected to said power supply for stepping down the voltage of said supply to a portion of said control circuitry, the low voltage portion of the circuitry including relay means for controlling contact operation in the high voltage portion of said circuitry, the contact operation in such high voltage portion providing reversal of the operation of the driving motor.

3. Apparatus as defined in claim 1, in which said relay means in said low voltage portion includes a pair of relay coils, and further including an interlock means for preventing supply of power or current to one of said relays when the other relay has been actuated or has already been energized, said control switch having at least a pair of fixed contacts one of which is connected to one of said relay coils and the other to the other of said relay coils.

4. Apparatus as defined in claim 1, in which said emergency switch has a pair of normally closed contacts and is connected to said control switch; a snap-action switch operable in response to cable slackening to cause opening of its normally closed contacts, the snap action switch being connected in series with said emergency switch; a pair of push button actuated re-set switches and a pair of indicator lamps or lights which are respectively operable in response to opening of the current supply to said control switch by opening of either said emergency of cable slackening responsive switch so as to cause said respective lamps to become illuminated, thereby to indicate a particular fault that has occurred, said push button switches being located adjacent the respective lamps and being operable to over-ride the said opening of contacts of the aforesaid switches so as to supply power selectively to said relays whereby the chair unit becomes operable.

* * * * *